US009788665B2

(12) United States Patent
Howard et al.

(10) Patent No.: US 9,788,665 B2
(45) Date of Patent: Oct. 17, 2017

(54) MERCHANDISING SYSTEM AND METHOD OF USE

(71) Applicant: Display Technologies, LLC, Lake Success, NY (US)

(72) Inventors: Andrew Howard, Larchmont, NY (US); Matthew Pichel, Englewood, NJ (US)

(73) Assignee: Display Technologies LLC, Lake Success, NY (US)

( * ) Notice: Subject to any disclaimer, the term of this patent is extended or adjusted under 35 U.S.C. 154(b) by 0 days.

(21) Appl. No.: 14/904,564

(22) PCT Filed: Jul. 11, 2014

(86) PCT No.: PCT/US2014/046272

§ 371 (c)(1),
(2) Date: Jan. 12, 2016

(87) PCT Pub. No.: WO2015/006638

PCT Pub. Date: Jan. 15, 2015

(65) Prior Publication Data

US 2016/0150894 A1 Jun. 2, 2016

Related U.S. Application Data

(60) Provisional application No. 61/845,604, filed on Jul. 12, 2013.

(51) Int. Cl.

| | |
|---|---|
| ***A47F 1/12*** | (2006.01) |
| ***A47F 5/00*** | (2006.01) |
| *G07F 11/42* | (2006.01) |

(52) U.S. Cl.
CPC ..... *A47F 1/125* (2013.01); *A47F 1/126* (2013.01); *A47F 5/0025* (2013.01); *G07F 11/42* (2013.01)

(58) Field of Classification Search
CPC ..... A47F 5/005; A47F 1/125; A47F 1/126; A47F 1/04; A47F 5/0025; A47F 3/14; A47F 5/0087; A47F 1/12; A47F 7/285
USPC ..... 211/59.2, 59.3, 150, 119.003, 184, 175, 211/59.4; 221/279, 227, 255, 90, 242, 221/226, 229, 231, 232
See application file for complete search history.

(56) References Cited

U.S. PATENT DOCUMENTS

| | | | | |
|---|---|---|---|---|
| 1,841,926 A * | 1/1932 | Wray | ..... | A47F 1/08 211/59.2 |
| 2,934,212 A | 4/1960 | Jacobson | | |
| 3,035,587 A | 5/1962 | Schade | | |

(Continued)

OTHER PUBLICATIONS

PCT International Preliminary Report on Patentability and Written Opinion for PCT/US2014/046272 dated Jan. 12, 2016.

(Continued)

*Primary Examiner* — Daniel J Troy
*Assistant Examiner* — Hiwot Tefera
(74) *Attorney, Agent, or Firm* — Carter, DeLuca, Farrell & Schmidt, LLP

(57) ABSTRACT

A merchandising system for a displaying a plurality of products is disclosed. The system includes a base and a product tray. The base includes a product-supporting surface which defines a longitudinal axis. The product tray is disposed adjacent a proximal portion of the base, includes a product-supporting surface, and is pivotal with respect to the base.

10 Claims, 14 Drawing Sheets

(56) References Cited

U.S. PATENT DOCUMENTS

| | | | | |
|---|---|---|---|---|
| 3,308,961 | A | 3/1967 | Chesley | |
| 4,830,201 | A | 5/1989 | Breslow | |
| 5,190,186 | A | 3/1993 | Yablans et al. | |
| 5,366,099 | A | 11/1994 | Schmid | |
| 5,469,976 | A | 11/1995 | Burchell | |
| 5,586,687 | A * | 12/1996 | Spamer | A47F 7/285 193/32 |
| 5,788,091 | A * | 8/1998 | Robertson | A47F 7/285 211/59.2 |
| 5,833,076 | A | 11/1998 | Harres et al. | |
| 6,041,720 | A | 3/2000 | Hardy | |
| 6,142,317 | A | 11/2000 | Merl | |
| 6,648,151 | B2 | 11/2003 | Battaglia et al. | |
| 7,063,217 | B2 | 6/2006 | Burke | |
| 7,424,957 | B1 * | 9/2008 | Luberto | A47F 1/126 211/59.3 |
| 7,513,390 | B2 * | 4/2009 | Artsiely | G07F 11/30 221/151 |
| 7,980,398 | B2 * | 7/2011 | Kahl | A47F 1/125 211/59.2 |
| 7,997,427 | B2 * | 8/2011 | Lowenbraun | A47F 1/12 211/59.2 |
| 8,276,766 | B2 * | 10/2012 | Rataiczak, III | A47F 1/126 211/184 |
| 2005/0098515 | A1 | 5/2005 | Close | |
| 2007/0170127 | A1 | 7/2007 | Johnson | |
| 2007/0175839 | A1 | 8/2007 | Schneider et al. | |
| 2009/0223914 | A1 * | 9/2009 | Kahl | A47F 7/285 211/59.2 |
| 2011/0163113 | A1 * | 7/2011 | Grubbs | A47F 3/002 221/311 |

OTHER PUBLICATIONS

International Search Report in PCT/US2014/046272 dated Nov. 4, 2014.

* cited by examiner

MERCHANDISING SYSTEM AND METHOD OF USE

CROSS-REFERENCE TO RELATED APPLICATION

The present application claims the benefit of, and priority to, U.S. Provisional Patent Application Ser. No. 61/845,604 filed on Jul. 12, 2013, the entire contents of which being incorporated by reference herein in its entirety.

BACKGROUND

The present disclosure relates generally to a merchandising system for displaying products on a shelf. More particularly, the present disclosure relates to a merchandising system and method for storing and/or displaying products to provide for the space-efficient presentation of groups of products within a given or fixed display area, and/or allowing for convenient and orderly presentation, dispensing, stocking, and storage of products.

Various types of product merchandisers are commonly used in retail environments to display different types of products. As opposed to simply positioning products on shelves, product displays are commonly used to position products on a shelf in manner which automatically advances (e.g., via gravity or a pusher) a trailing or distal product (i.e., a product that is behind a lead or proximal-most product) closer to a consumer once the lead product has been removed from the shelf. As can be appreciated, such product displays facilitate the arrangement and upkeep of products, as the trailing products do not have to be manually moved toward the front of the shelf, for instance.

SUMMARY

The present disclosure relates to a merchandising system for a displaying a plurality of products. The system includes a base and a product tray. The base includes a first product-supporting surface which defines a longitudinal axis. The product tray is disposed adjacent a proximal portion of the base, includes a second product-supporting surface, and is pivotal with respect to the base.

In disclosed embodiments, the product tray is pivotal between a first position where the product-supporting surface of the product tray is disposed at a non-parallel angle with respect to the product-supporting surface of the base, and a second position where at least a portion of the product-supporting surface of the product tray is longitudinally aligned with the product-supporting surface of the base. Here, it is disclosed that the product tray is biased toward its first position. It is further disclosed that the product tray is configured to move toward its second position when a product contacts the product-supporting surface of the product tray.

In disclosed embodiments, the product tray includes a proximal member extending substantially perpendicularly from the product-supporting surface of the product tray and is configured to help maintain a product on the product tray.

In disclosed embodiments, the system further includes a pusher assembly including a pusher member disposed in mechanical cooperation with the base and being configured to urge products on the base toward the proximal portion of the base. Here, it is disclosed that the pusher assembly further includes a biasing member configured to urge the pusher member proximally. The biasing member extends through a portion of the product tray. It is further disclosed that the base includes a clamping portion disposed adjacent its proximal portion, and that a portion of the biasing member is disposed between the clamping portion of base and a clamping portion of the product tray. It is also disclosed that the movement of the product tray from its first position toward its second position causes the clamping portion of the product tray to move toward the clamping portion of the base thereby clamping the portion of the biasing member disposed therebetween.

The present disclosure also relates to a method of displaying products. The method includes providing a merchandising system and positioning a product on at least one of a base and a product tray of the merchandising system. The base includes a product-supporting surface which defines a longitudinal axis. The product tray is disposed adjacent a proximal portion of the base, includes a product-supporting surface, and is pivotal with respect to the base.

In disclosed embodiments, the method further includes pivoting the product tray between a first position where the product-supporting surface of the product tray is disposed at a non-parallel angle with respect to the product-supporting surface of the base, and a second position where at least a portion of the product-supporting surface of the product tray is longitudinally aligned with the product-supporting surface of the base. Here, it is disclosed that the product tray is biased toward its first position. It is also disclosed that the method further includes urging the product proximally into contact with the product-supporting surface of the product tray such that the product tray moves toward its second position.

In disclosed embodiments, the product tray includes a proximal member extending substantially perpendicularly from the product-supporting surface of the product tray and is configured to help maintain a product on the product tray.

In disclosed embodiments, the method further includes proximally urging a product disposed on the base via a pusher assembly. The pusher assembly includes a pusher member disposed in mechanical cooperation with the base, and a biasing member configured to urge the pusher member proximally. The biasing member extends through a portion of the product tray. Here, it is disclosed that the base includes a clamping portion disposed adjacent its proximal portion. A portion of the biasing member is disposed between the clamping portion of base and a clamping portion of the product tray. It is further disclosed that the method includes moving the product tray from its first position toward its second position to cause the clamping portion of the product tray to move toward the clamping portion of the base thereby clamping the portion of the biasing member disposed therebetween. It is further disclosed that the method includes clamping a portion of the biasing member to reduce the amount of proximal force exerted by the pusher member.

In disclosed embodiments, the method includes changing the amount of force exerted by the pusher member by removing a product from the merchandising system.

BRIEF DESCRIPTION OF DRAWINGS

Embodiments of the present disclosure are described hereinbelow with reference to the drawings wherein.

DESCRIPTION

Embodiments of the presently disclosed merchandising system are described in detail with reference to the drawings wherein like numerals designate identical or corresponding elements in each of the several views. As is common in the art, the term "proximal" refers to that part or component closer to the user, e.g., customer, while the term "distal" refers to that part or component farther away from the user.

Figure 1:
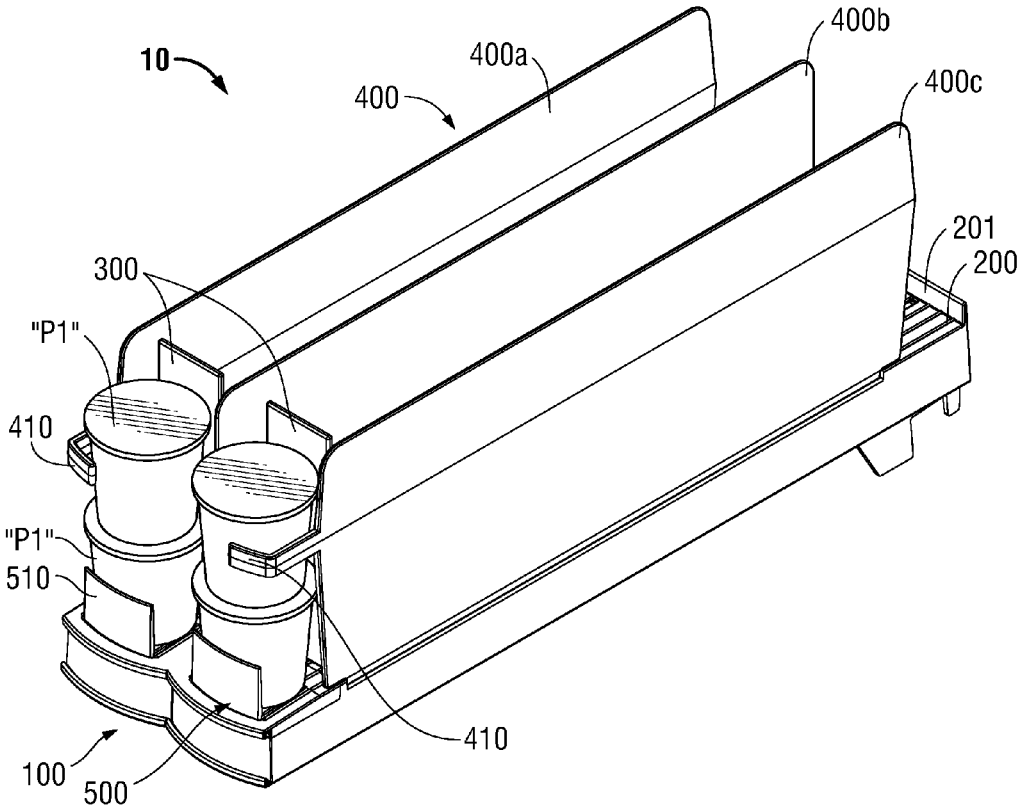
FIG. 1 is a perspective view of a guide assembly of a merchandising system for displaying items on a shelf according to embodiments of the present disclosure, the guide assembly is illustrated including two stacked products on each base.
Figure 2:
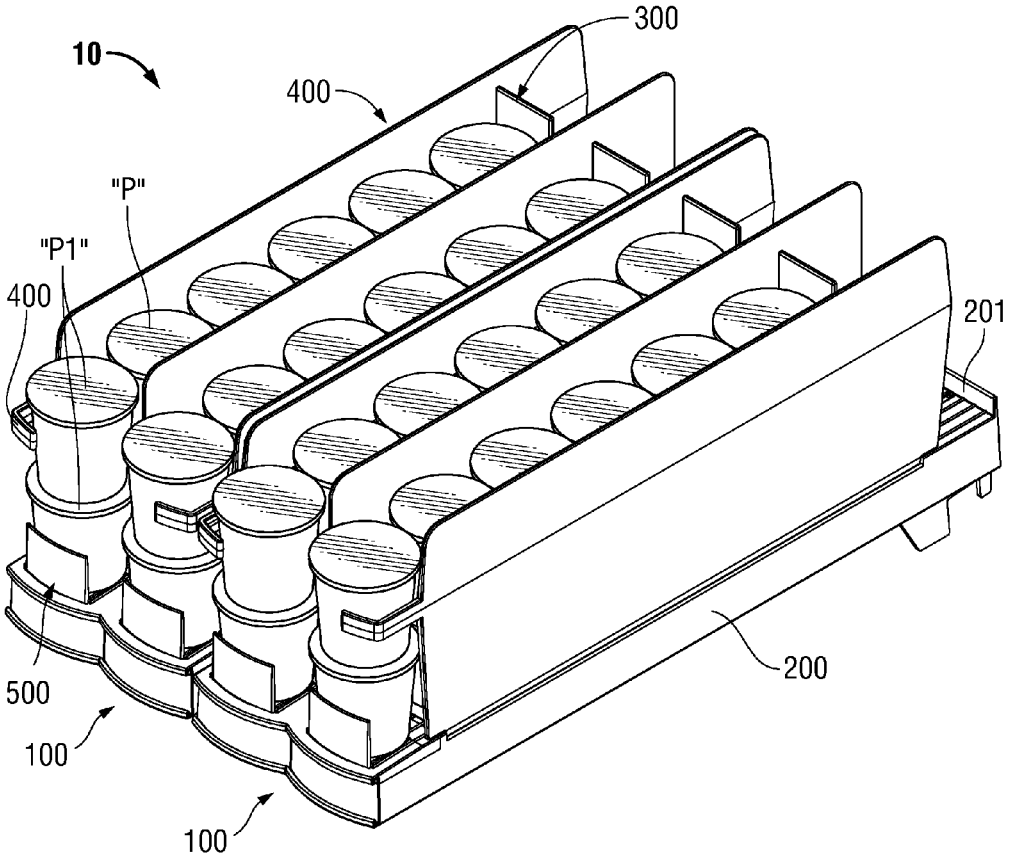
FIG. 2 is a perspective view of the merchandising system of FIG. 1 including two guide assemblies with a plurality of products thereon.
Figure 3:
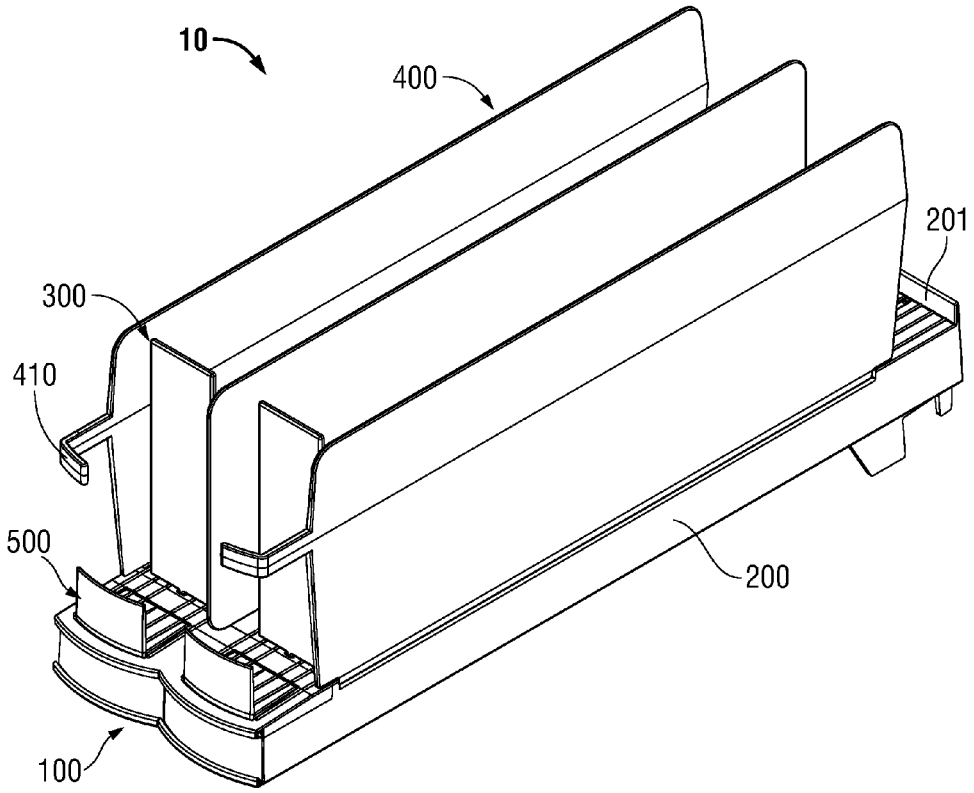
FIG. 3 is a perspective view of the merchandising system of FIGS. 1 and 2 illustrated with no products thereon.

Generally, with particular reference to FIGS. 1-3, a merchandising system 10 is disclosed that includes a plurality of guide assemblies 100. In the illustrated embodiments, each guide assembly 100 includes two bases 200, two pusher assemblies 300, three lateral guides 400, and two pivotal product trays 500. While the illustrated embodiments show guide assembly 100 configured for merchandising two rows of products "P," it is envisioned and within the scope of the present disclosure that each guide assembly 100 is configured for merchandising one row of products such that one guide assembly 100 would include one base 200, one pusher assembly 300, two lateral guides 400, and one pivotal product tray 500.

One merchandising system 10 includes a plurality guide assemblies 100. In the embodiment illustrated in FIG. 2, merchandising system 10 includes two guide assemblies 100, which, as shown, includes four bases 200. In disclosed embodiments, merchandising system 10 includes any number of guide assemblies 100. As can be appreciated, several merchandising systems 10 are able to be positioned adjacent one another on a shelf.

The base 200, which is designed to be placed on a horizontal or inclined store shelf (or to be secured to a vertical wall (e.g., a peg-board surface)), is configured to support a plurality of products "P" thereon. In the illustrated embodiments, base 200 is shown with products "P" (e.g., yogurt containers) that are stacked atop each other. The pusher assembly 300 is configured to urge product(s) "P" on the base 200 toward a proximal member 510 of pivotal product tray 500. The lateral guides 400 are disposed in mechanical cooperation with base 200 (e.g., are integrally formed therewith, connectable thereto, etc.) and help maintain the products "P" on the base 200. A distal rail 201 extends upward from base 200 and is also configured to help maintain the products "P" on the base 200. The pivotal product tray 500 is disposed in pivotal engagement with a proximal portion 202 of base 200 and is configured to limit the amount of force enacted on a lead product "P1" by pusher assembly 300 (as will be discussed in detail below).

Figure 4:
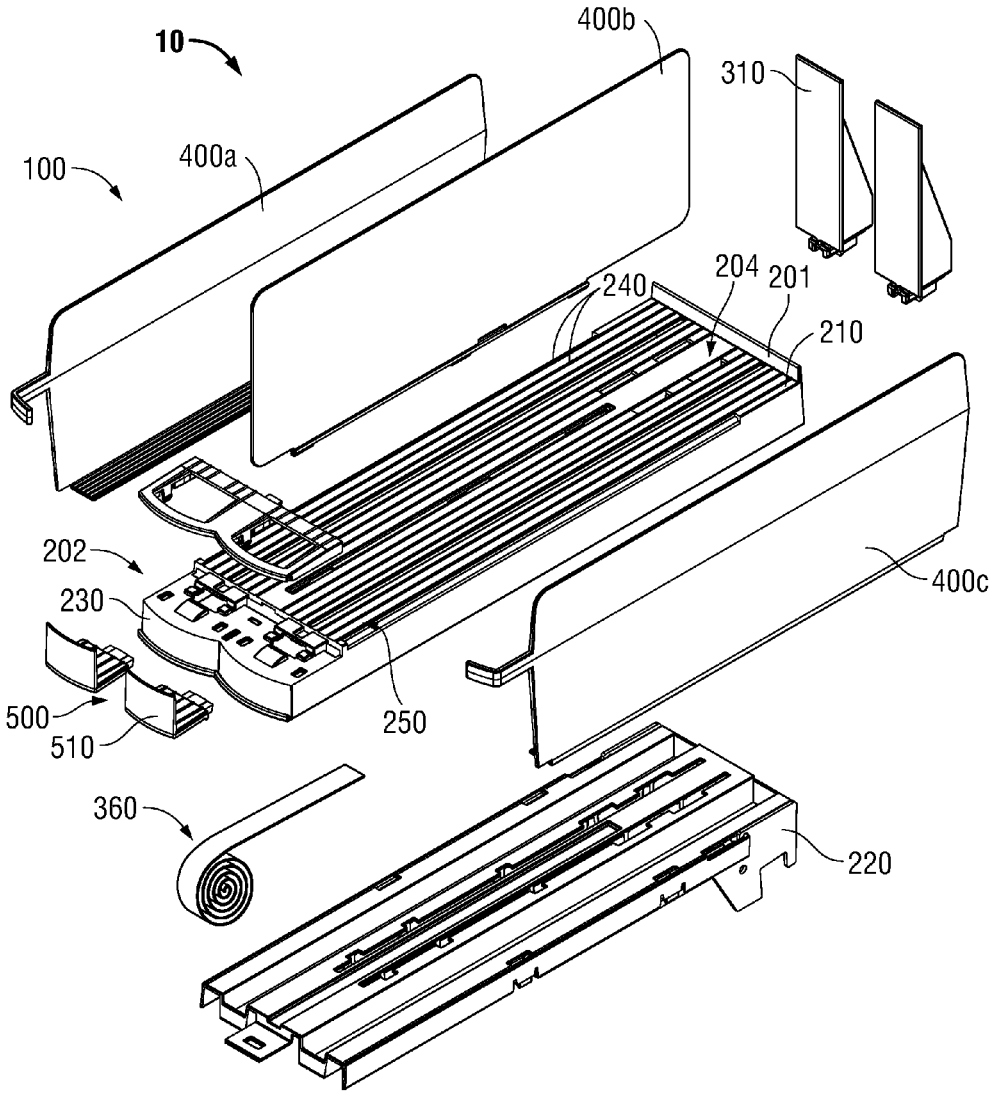
FIG. 4 is a perspective, assembly view of the merchandising system.
Figure 5:
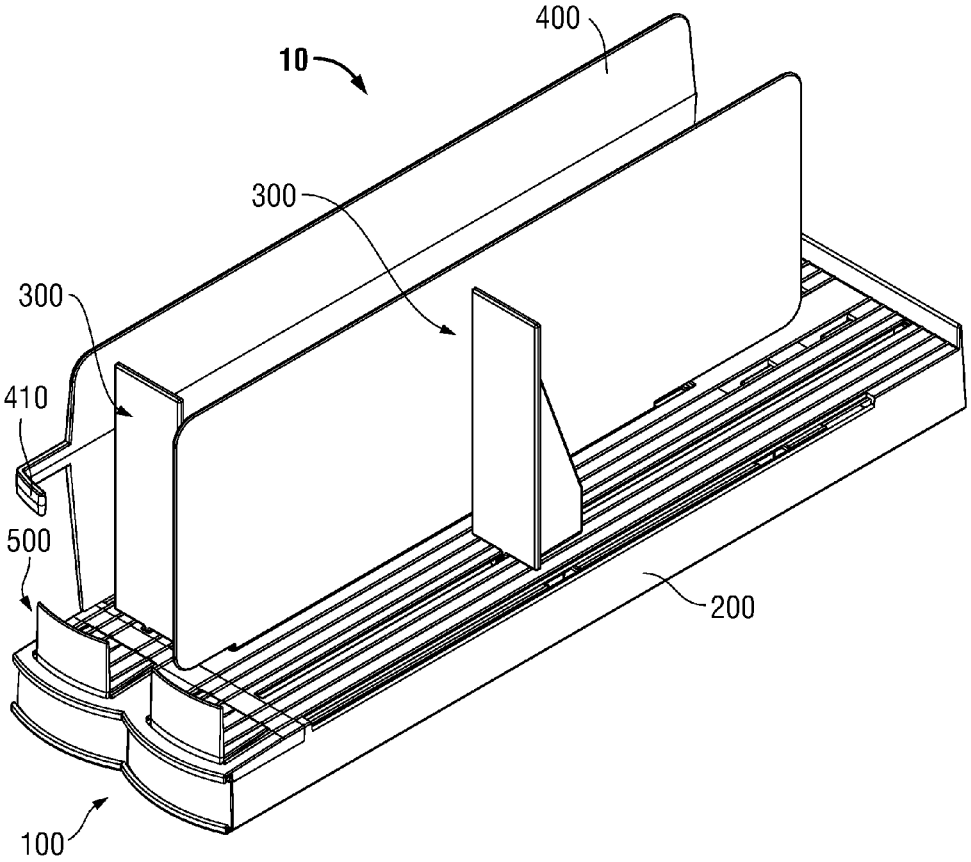
FIG. 5 is a perspective view of the merchandising system illustrating one pusher in an advanced position, one pusher in an intermediate position, and the omission of a lateral guide.
Figure 6:
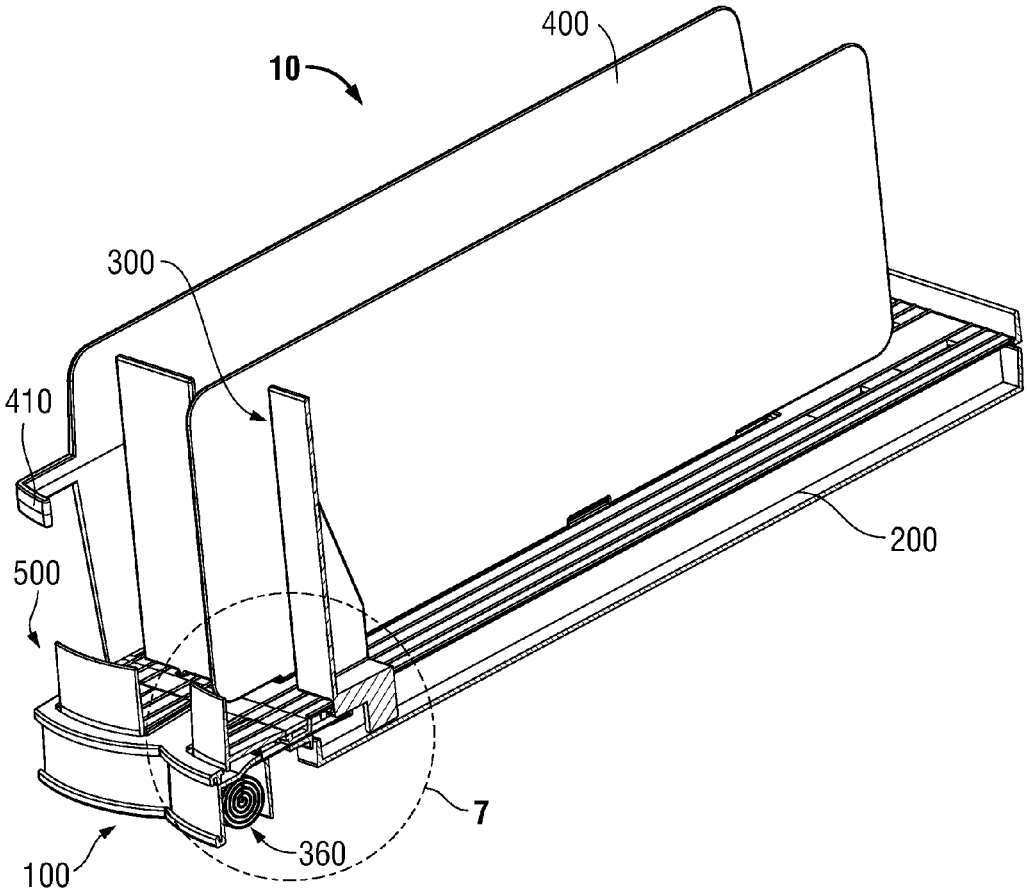
FIG. 6 is a partially cut-away view of the merchandising system of FIG. 5.

With additional reference to FIG. 4, the base 200 includes a first product-supporting portion 210, a support member 220, a proximal wall 230, a plurality of longitudinally extending ribs 240, and a track 250. The product-supporting portion 210 defines a longitudinal axis and is the portion of the base 200 that includes ribs 240 and track 250. The support member 220 provides support to product-supporting portion 210 and helps support a pusher member 310 of pusher assembly 300. The proximal wall 230 extends downwardly from a proximal-most portion of product-supporting portion 210. The ribs 240 extend axially along at least a portion of product-supporting portion 210 of base 200 between a proximal portion 202 of the base 200 and a distal portion 204 of the base 200, and are configured to reduce friction when a product "P" slides therealong, for example.

Figure 7:
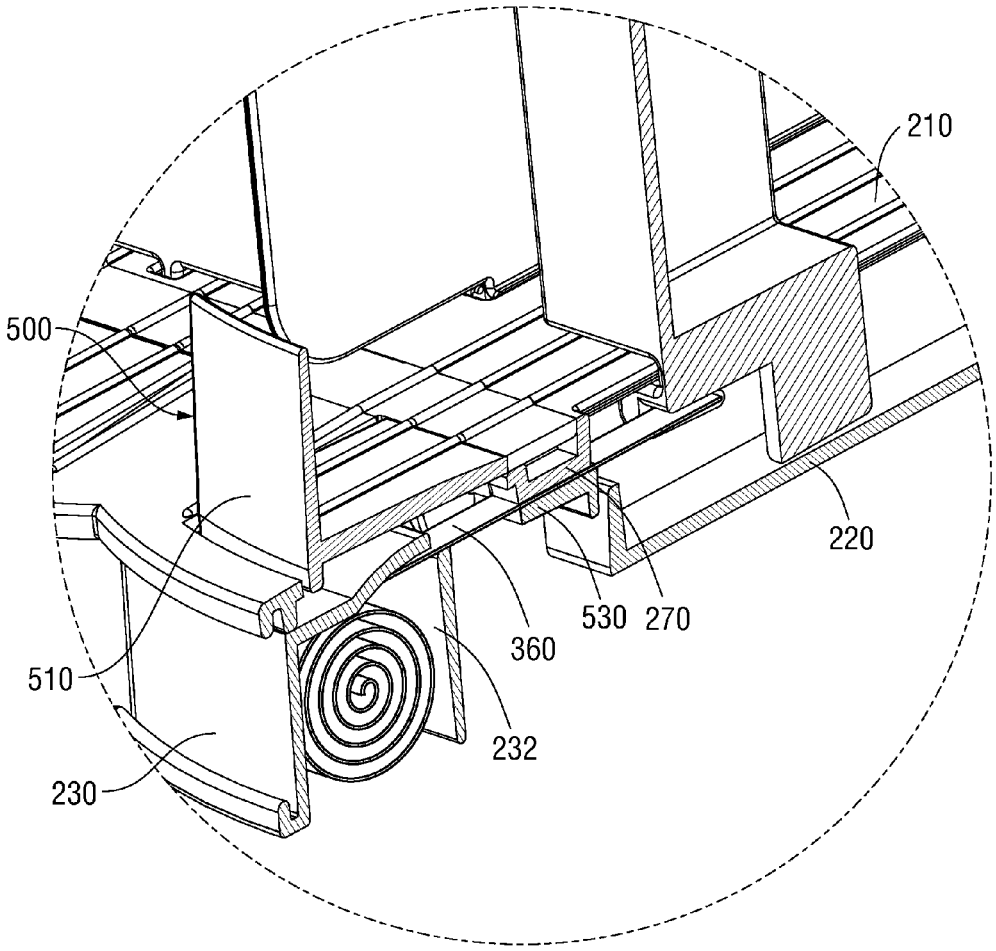
FIG. 7 is an enlarged view of the area of detail indicated in FIG. 6.
Figure 11:
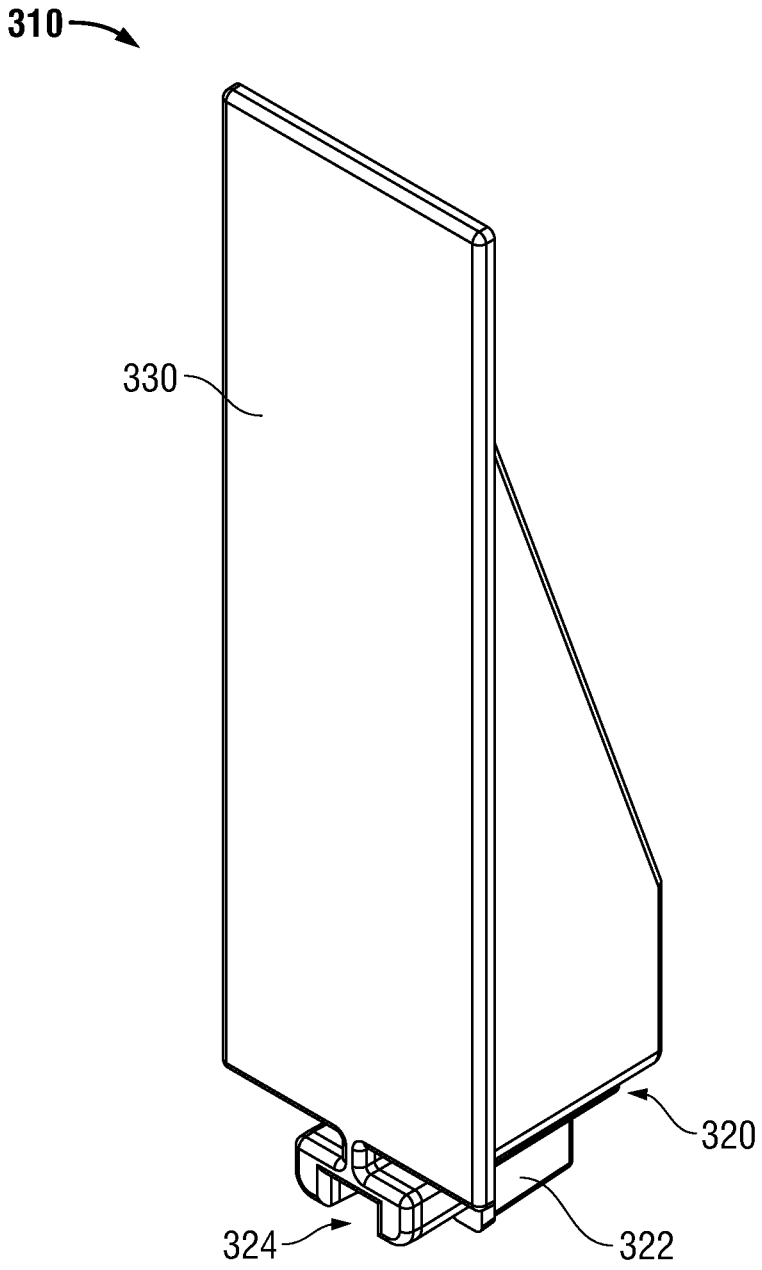
FIGS. 11-13 are various views of a pusher of the merchandising system.
Figure 12:
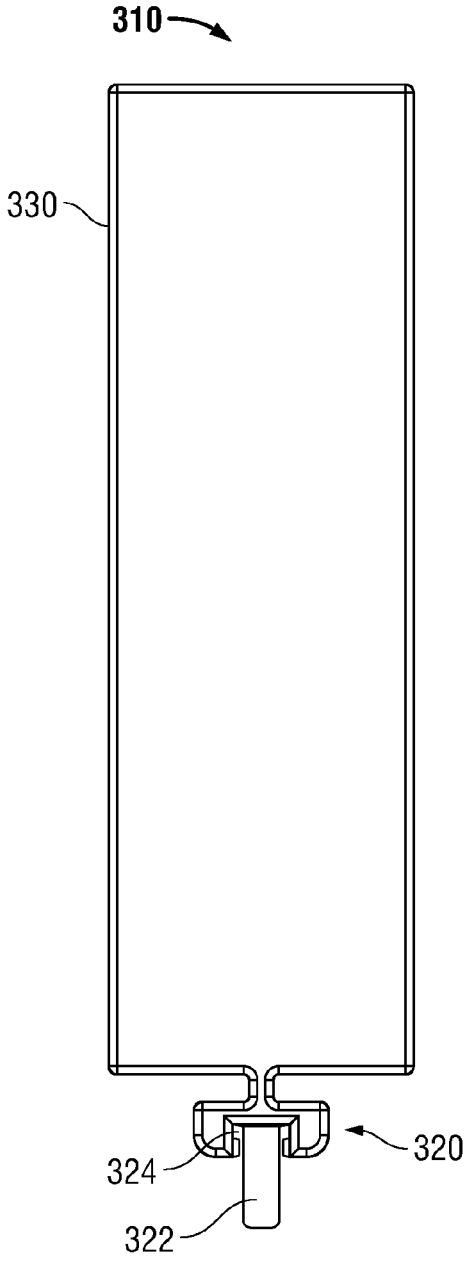
Figure 13:
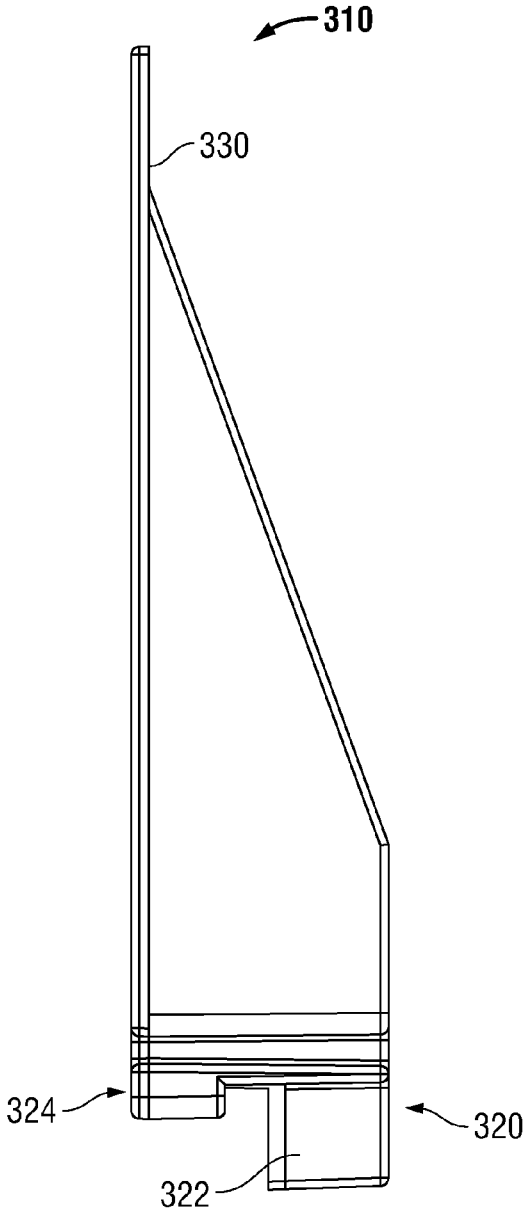

With continued reference to FIG. 4 and with additional reference to FIGS. 11-13, the pusher assembly 300 includes pusher member 310 and a biasing member 360 (e.g., a coiled spring). Pusher assembly 300 is configured to bias products "P" on base 200 in a proximal direction. Pusher member 310 includes a base member 320 and a substantially vertical member 330. In the illustrated embodiment, the vertical member 330 has a planar shape, but it is envisioned that vertical member 330 includes an arcuate shape configured to correspond to the contour of the product "P" (e.g., a yogurt container or a portion thereof) positioned thereagainst. A portion of the base member 320 extends below product-supporting portion 210 of base 200, and a leg 322 of base member 320 is configured to be supported and/or guided by support member 220. Base member 320 also includes a slot 324 which is configured for a portion of biasing member 360 to pass through and/or be secured to. Pusher member 310 is configured to longitudinally slide with respect to the product-supporting surface 210 of the base 200. A coiled portion of biasing member 360 is positioned beneath proximal portion 202 of base 200, and is located between proximal wall 230 and a second wall 232 (see FIG. 7, for example). Second wall 232 depends downward from proximal portion 202 of base and distally of proximal wall 230. Additionally, a portion of biasing element 360 extends through a gap "G" (see FIG. 8B, for example) between a clamping portion 270 of base 200 and a clamping portion 530 of pivotal product tray 500.

With reference to FIGS. 1 and 2, for example, lateral guides 400 are shown including fingers 410 extending from a proximal portion thereof. More particularly, outer lateral guides 400*a* and 400*c* are each illustrated having one finger 410 that is proximally-extending and inwardly-directed. In this configuration, fingers 410 help maintain products "P" on merchandiser 10 by resisting the force exerted by pusher assembly 300 (especially an upper product when the products are stacked, as illustrated). Additionally, while a center lateral guide 400*b* is shown not including any fingers 410, it is envisioned that lateral guide 400*b* includes one or more fingers. It is further envisioned that when more than one guide assemblies 100 are positioned side-by-side, one of the outer lateral guides 400*a* or 400*c* on a first guide assembly 100 can not be included, and the other outer lateral guide 400*c* or 400*a*, respectively, can include two fingers 410.

Referring now to FIGS. 6-10, further details of pivotal product tray 500 are shown. Pivotal product tray 500 includes proximal member 510, a second product-supporting surface or portion 520, and clamping portion 530. Pivotal product tray 500 is configured to pivot with respect to proximal portion 202 of base 200 via a pin 240. More particularly, pivotal product tray 500 is pivotable from a first position (FIG. 8B) wherein there is no product "P" in contact with product-supporting portion 520, and a second position (FIGS. 8A and 8D) wherein there is a product "P" in contact with product-supporting portion 520. FIG. 8C illustrates pivotal product tray 500 after a product "P" has made initial contact with product-supporting portion 520, and where pivotal product tray 500 is about to move from its first position to its second position.

Figure 8A:
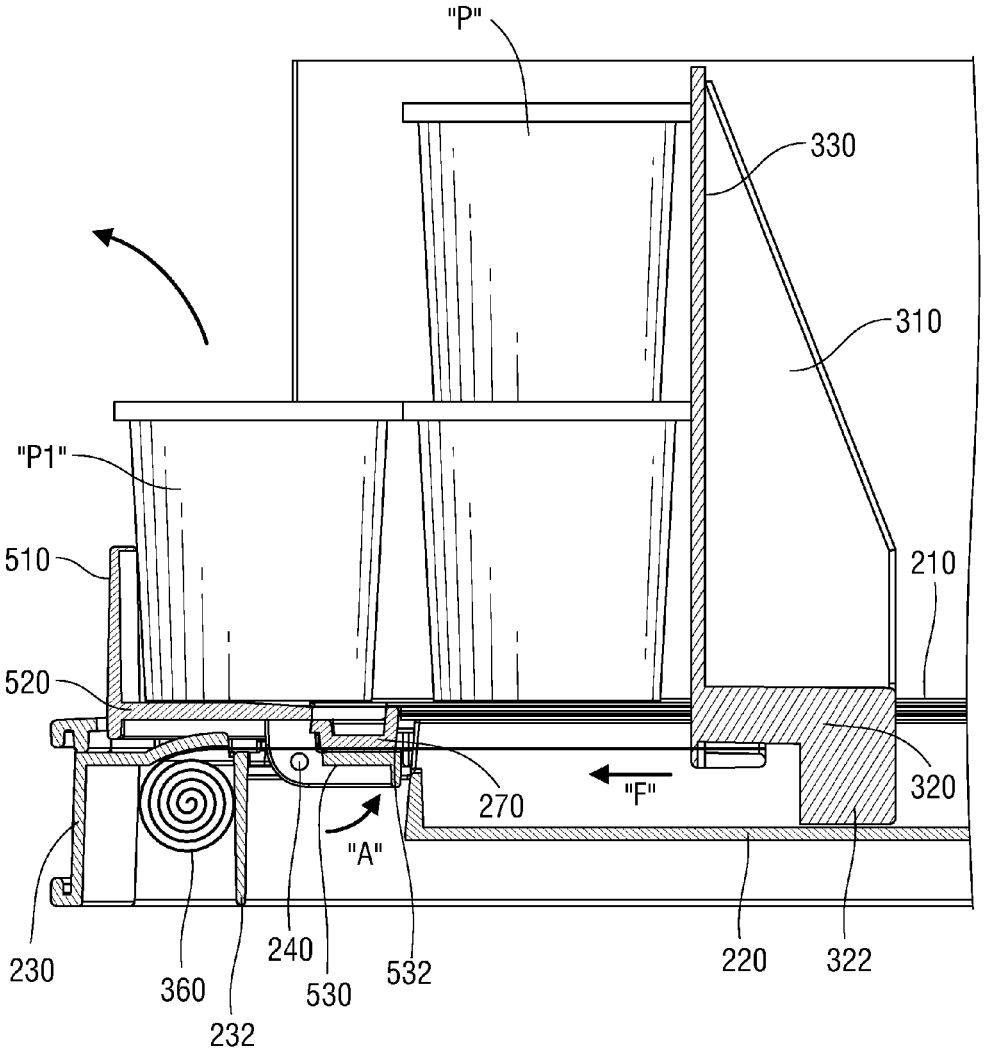
FIGS. 8A-8D are longitudinal cross-sectional views of the portion of the merchandising system illustrated in FIG. 7, illustrating various stages of product removal from the guide assembly.

With particular reference to FIG. 8A, pivotal product tray 500 is shown in its second position, when a lead product "P1" is supported by product-supporting portion 520 and where the lead product "P1" is in contact with proximal member 510 under the bias of pusher assembly 300. Here, at least a portion (e.g., a majority or entirety) of product-supporting portion 520 is substantially aligned (i.e. parallel) with product-supporting portion 210 of base 200. In this position, there is a maximum amount of clamping force provided against the portion of biasing member 360 that is between clamping portion 270 of base 200 and a clamping member 532 of clamping portion 530 of pivotal product tray 500 in the substantial direction of arrow "A." More particularly, the entirety (or the substantial entirety) of clamping portion 270 and clamping member 532 are in contact with biasing member 360. Further, the weight of lead product(s) "P1" forces product-supporting portion 520 downward, and thus forces clamping portion 530 upwards against biasing member 360. Thus, the proximally exerted force "F" enacted by the pusher member 310 to the products "P" (provided by biasing member 360) is reduced by the clamping force and/or frictional force (provided by clamping portion 270 and clamping member 532).

Figure 8B:
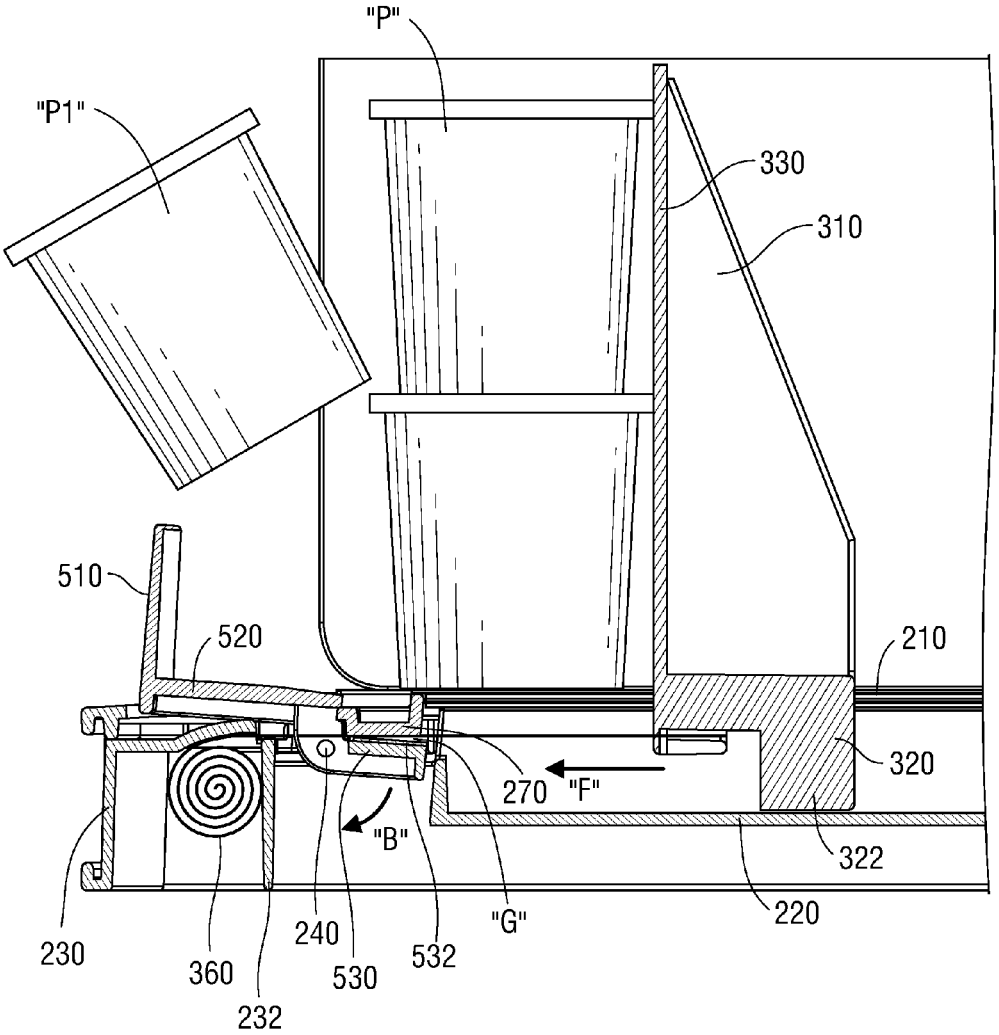

With particular reference to FIG. 8B, pivotal product tray 500 is shown in its first position, where the lead product "P1" has been removed from merchandising system 10. Here, there is a minimum amount of clamping force provided against the portion of biasing member 360 that is between clamping portion 270 of base 200 and clamping member 532 of pivotal product tray 500. That is, pivotal product tray 500 has pivoted in the substantial direction of arrow "B" into its unbiased position. Here, a gap "G" exists between distal portions of clamping portion 270 and clamping member 532. Thus, in this position, since there is less clamping force acting on biasing member 360, pusher member 310 exerts a relatively stronger proximal force "F" against the products "P" as compared to when pivotal product tray is in its second position (FIG. 8A). The force "F" exerted by biasing member 360 causes products "P" to move proximally along base 200.

Figure 8C:
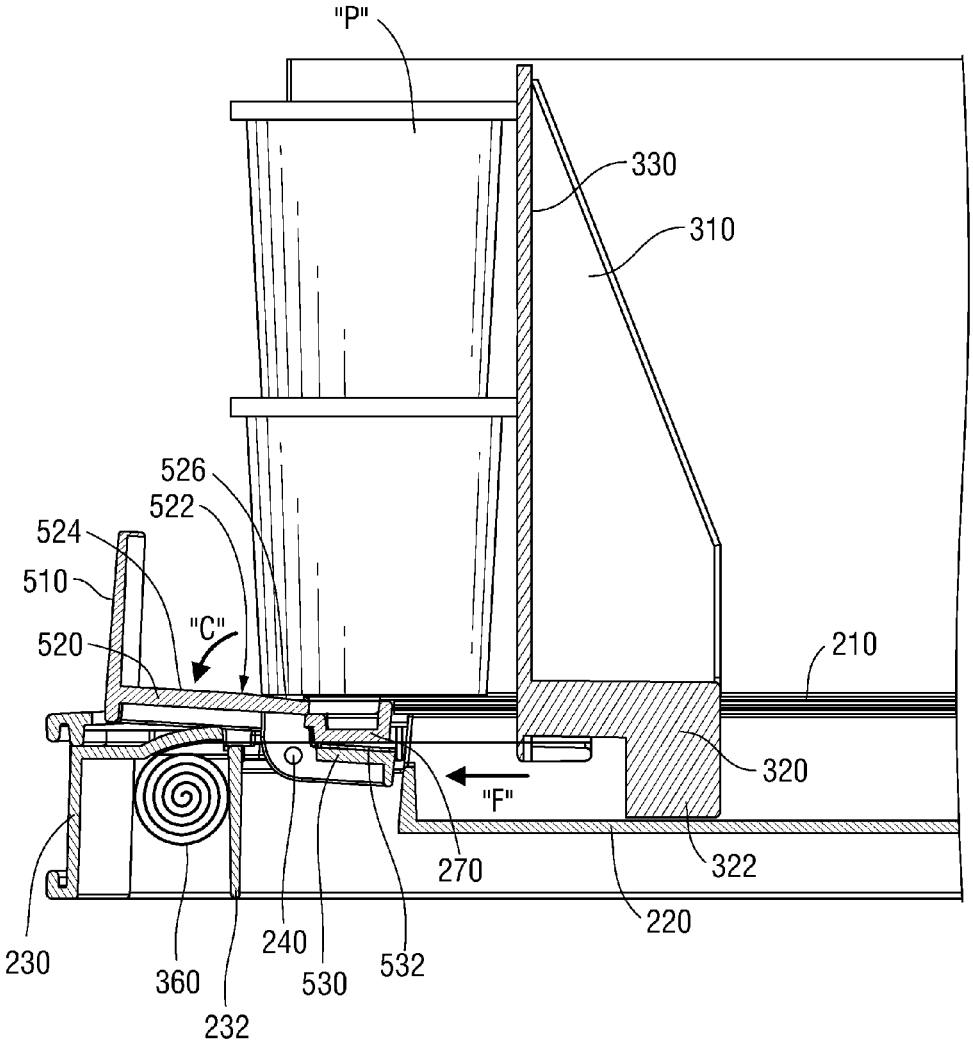

With particular reference to FIG. 8C, the products "P" are shown having moved proximally with respect to their positions in FIG. 8B. Here, the (new) lead product "P1" makes initial contact with pivotal product tray 500, which will cause pivotal product tray 500 to pivot in the general direction of arrow "C" toward its second position.

Figure 8D:
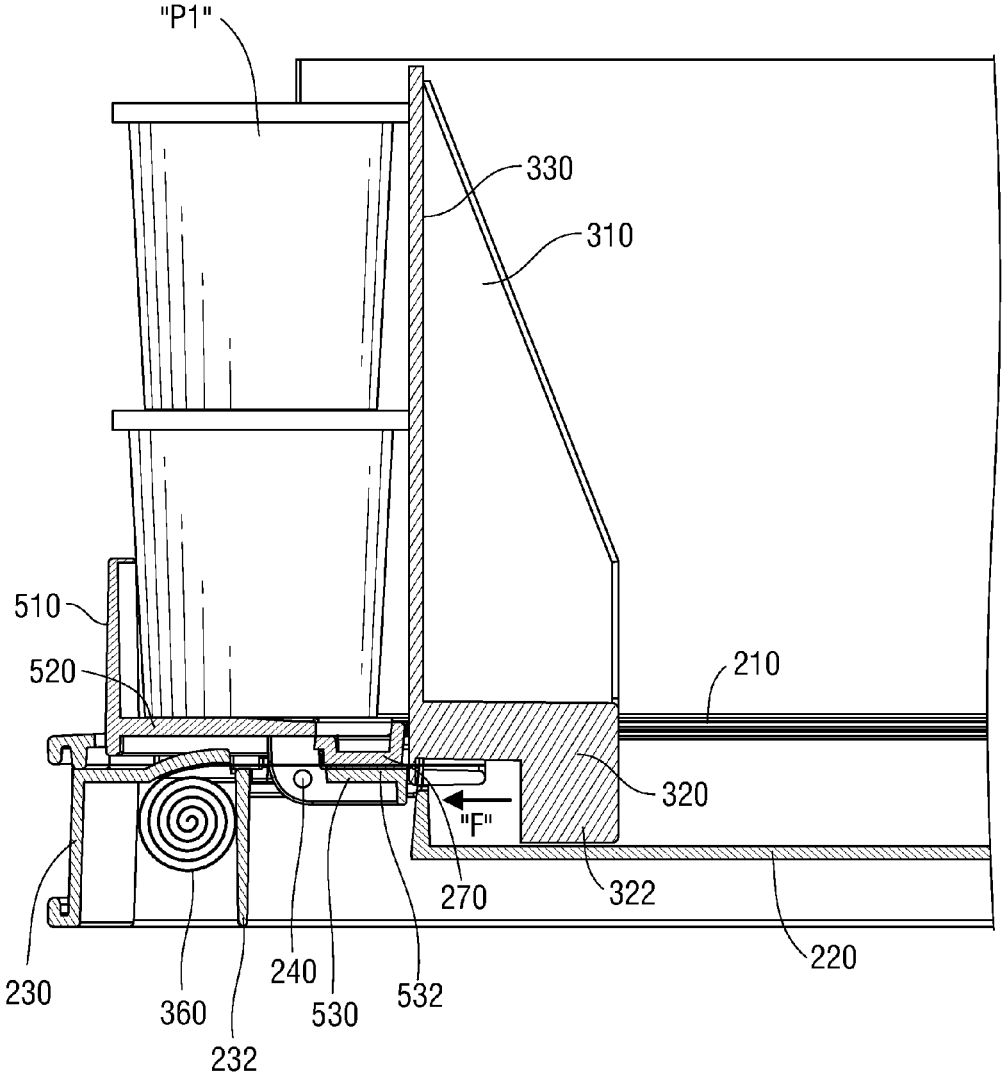
Figure 9:
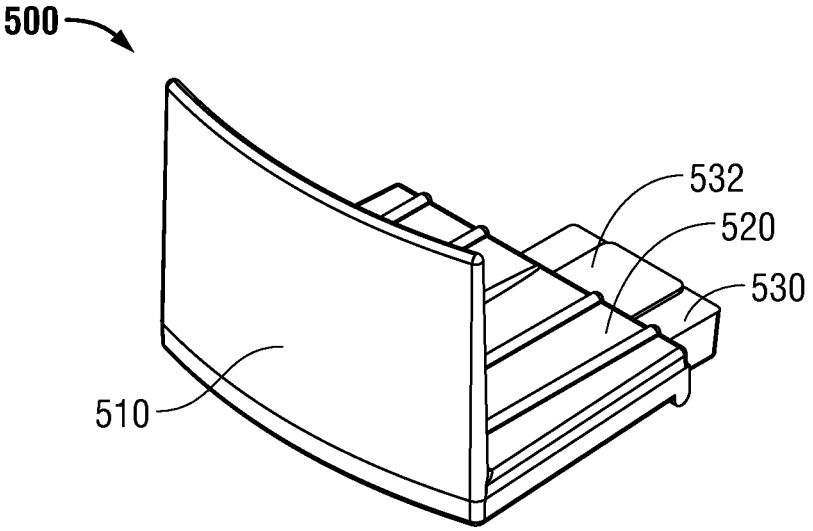
FIGS. 9 and 10 are perspective views of a pivotal product tray of the merchandising system.
Figure 10:
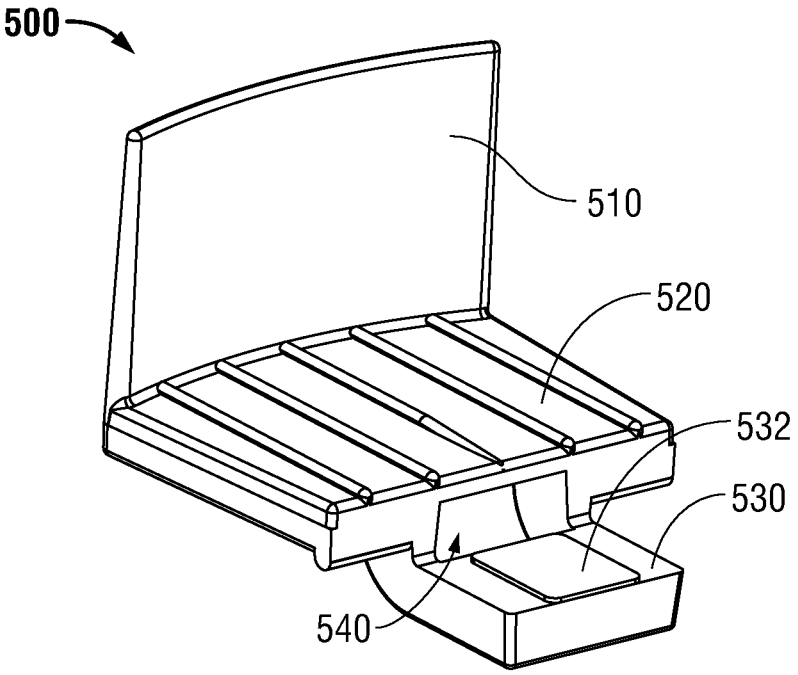

With particular reference to FIG. 8D, the products "P" are shown in a proximal-most position, between pusher member 310 and proximal member 510, and with pivotal product tray 500 in its second position. As discussed above with reference to FIG. 8A, the proximally exerted force "F" enacted by the pusher member 310 to the products "P" is minimized in this position.

Thus, the proximal force "F" exerted by pusher member 310 is greatest when products "P" are disposed distally of and not in contact with proximal member 510 (e.g., directly after a lead product "P1" has been shopped; see FIGS. 8B and 8C), and is smallest when the lead product "P1" is in a proximal-most position (i.e., in contact with proximal member 510; see FIGS. 8A and 8D). As can be appreciated, a relatively large amount of force may be desired when products "P" are disposed distally of and not in contact with proximal member 510 in order to cause the products "P" to move proximally. Additionally, a relatively small amount of force may be desired when the lead product "P1" is in contact with proximal member 510 to help prevent the lead product "P1" from toppling over, to help prevent damaging products "P" (e.g., due to excess forces acting thereagainst), and to help facilitate a customer remove the lead product "P1" from merchandiser 10.

It is envisioned that one or both of clamping portions 270 and 530 include a relatively high-friction material (e.g., rubber) to increase the frictional force acting on the portion of biasing member 360 that passes therethrough. It is further envisioned to distribute the weight of various parts of the pivotal product tray 500 to change the clamping forces provided thereby. For example, if clamping portion 530 were made relatively heavier than product-supporting portion 520, the resulting clamping force provided by clamping portion 530 would decrease, and vice versa (especially when pivotal product tray 500 is in its first position). Further, it is envisioned that a biasing element is included in merchandiser 10 to bias (or provide additional bias to) pivotal product tray 500 toward its first position.

Additionally, it is envisioned that product-supporting portion 520 includes a flat, ramped, angled, curved or camming surface 522, or any combinations thereof. In the illustrated embodiments, surface 522 of product-supporting portion 520 includes a flat portion 524 and an angled or ramp portion 526 (see FIG. 8C, for example). It is envisioned that that orientation of surface 522 further regulates the amount of clamping force provided by pivotal product tray 500 and the timing of when pivotal product tray 500 initially moves from its first position toward its second position, for example. More particularly, in the illustrated embodiment, the inclusion of ramp portion 526 causes a product "P" to initially contact pivotal product tray 500 (which moves pivotal product tray 500 toward its second position) slightly later than when a product "P" would contact pivotal product tray 500 if surface 522 were entirely flat, for example.

It is further envisioned that at least a portion of the proximal member 510 is transparent or translucent to allow a consumer to view a portion of the proximal-most product "P1" on the merchandising system 10 therethrough. Additionally, it is envisioned that proximal member 510 includes an arcuate shape, which is configured to correspond to the contour of the product "P" (e.g., yogurt container or portion thereof) supported thereagainst.

The present disclosure also includes a method of displaying items or products using the merchandising system 10 described above, a method of pivoting pivotal product tray 500, and a method of reducing the amount of force applied to products on merchandiser 10.

While several embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of the claims appended hereto.

The invention claimed is:

1. A merchandising system for displaying a plurality of products, the system comprising:

a base including a product-supporting surface and a clamping portion, the clamping portion disposed adjacent a proximal portion of the base, the product-supporting surface of the base defining a longitudinal axis;

a product tray disposed adjacent the proximal portion of the base, the product tray including a product-supporting surface and being pivotal with respect to the base, the product tray is pivotal between a first position where the product-supporting surface of the product tray is disposed at a non-parallel angle with respect to the product-supporting surface of the base and a second position where at least a portion of the product-supporting surface of the product tray is longitudinally aligned with the product-supporting surface of the base; and a pusher assembly including a pusher member disposed in mechanical cooperation with the base and being configured to urge products on the base toward the proximal portion of the base, wherein the pusher assembly further includes a biasing member configured to urge the pusher member proximally, the biasing member extending through a portion of the product tray, a portion of the biasing member is disposed between the clamping portion of base and a clamping portion of the product tray, wherein the movement of the product tray from its first position toward its second position causes the clamping portion of the product tray to move toward the clamping portion of the base thereby clamping the portion of the biasing member disposed therebetween.

2. The merchandising system of claim 1, wherein the product tray is biased toward its first position.

3. The merchandising system of claim 1, wherein the product tray is configured to move toward its second position when a product contacts the product-supporting surface of the product tray.

4. The merchandising system of claim 1, wherein the product tray includes a proximal member extending perpendicularly from the product-supporting surface of the product tray and being configured to help maintain a product on the product tray.

5. A method of displaying products, the method comprising:

providing a merchandising system including:

a base including a product-supporting surface and a clamping portion, the clamping portion is disposed adjacent a proximal portion of the base, the product-supporting surface of the base defining a longitudinal axis; and a product tray disposed adjacent the proximal portion of the base, the product tray including a product-supporting surface and being pivotal with respect to the base;

positioning a product on the base;

urging a product disposed on the base proximally via a pusher assembly, the pusher assembly including a pusher member disposed in mechanical cooperation with the base and a biasing member configured to urge the pusher member proximally, the biasing member extending through a portion of the product tray, a portion of the biasing member is disposed between the clamping portion of base and a clamping portion of the product tray; and pivoting the product tray from a first position where the product-supporting surface of the product tray is disposed at a non-parallel angle with respect to the product-supporting surface of the base toward a second position where at least a portion of the product-supporting surface of the product tray is longitudinally aligned with the product-supporting surface of the base to cause the clamping portion of the product tray to move toward the clamping portion of the base thereby clamping the portion of the biasing member disposed therebetween.

6. The method of claim 5, wherein the product tray is biased toward the first position.

7. The method of claim 5, further including urging the product proximally into contact with the product-supporting surface of the product tray such that the product tray moves toward the second position.

8. The method of claim 5, wherein the product tray includes a proximal member extending substantially perpendicularly from the product-supporting surface of the product tray and being configured to help maintain a product on the product tray.

9. The method of claim 5, further including clamping a portion of the biasing member to reduce the amount of proximal force exerted by the pusher member.

10. The method of claim 5, further including changing the amount of force exerted by the pusher member by removing a product from the merchandiser.

* * * * *